US011051643B1

(12) United States Patent
Stephens

(10) Patent No.: US 11,051,643 B1
(45) Date of Patent: Jul. 6, 2021

(54) SLEEVE CLIP ASSEMBLY

(71) Applicant: Teresa Stephens, San Antonio, TX (US)

(72) Inventor: Teresa Stephens, San Antonio, TX (US)

( * ) Notice: Subject to any disclaimer, the term of this patent is extended or adjusted under 35 U.S.C. 154(b) by 93 days.

(21) Appl. No.: 16/366,141

(22) Filed: Mar. 27, 2019

Related U.S. Application Data

(60) Provisional application No. 62/719,140, filed on Aug. 17, 2018.

(51) Int. Cl.
*A47G 25/90* (2006.01)

(52) U.S. Cl.
CPC ..... *A47G 25/90* (2013.01)

(58) Field of Classification Search
CPC ..... A47G 25/90; A47G 25/901–908; A41B 11/10; A41B 13/04; A41D 27/12; A41D 13/08; A41D 13/088; A41D 17/00; A41D 2400/44; A41F 9/00; A41F 11/00; A41F 11/16; A41F 13/00; A41F 17/00; A41F 17/02; A41F 17/04; A41F 1/00; Y10T 24/1362
USPC ..... D2/641, 860
See application file for complete search history.

(56) References Cited

U.S. PATENT DOCUMENTS 216,158 A 6/1879 Doring
255,552 A * 3/1882 Webster ..... A47G 25/90 2/59
365,894 A 7/1887 Zoller
597,883 A * 1/1898 Kepler
613,816 A 11/1898 Harrison
636,765 A 11/1899 Daniels
696,842 A * 4/1902 Phelps
778,654 A 12/1904 Gillen
848,584 A 3/1907 Albin et al.
932,423 A 8/1909 Allen
1,336,339 A * 4/1920 Beale ..... A47G 25/90 2/59
1,634,169 A * 6/1927 Moseley ..... A41F 11/16 2/315
1,782,057 A 11/1930 Bollinger
1,804,308 A 5/1931 Bollinger
2,441,545 A * 5/1948 Mason ..... A41F 11/16 2/314
2,670,474 A * 3/1954 Schultz ..... A41F 17/00 2/312

(Continued)

*Primary Examiner* — Ismael Izaguirre
(74) *Attorney, Agent, or Firm* — Suzanne Kikel, Patent Agent

(57) ABSTRACT

A sleeve clip assembly for preventing the bunching of a long-sleeved shirt while a user's arm is being inserted into the sleeve of another article of clothing. The sleeve clip assembly has a wristband that wraps around the user's wrist and secured into place by first and second hook-and-loop fastener means. A clasp assembly is attached to a cuff of a long-sleeved shirt. The sleeve clip assembly further includes a band attached to the wristband; a connector element secured to the band; a clasp assembly for gripping a cuff of the sleeve of the long-sleeved shirt; a hinge attached to the clasp assembly for pivotally connecting the clasp assembly to the connector element and the band of the wristband of the sleeve clip assembly. Related methods for using the sleeve clip assembly are also disclosed.

16 Claims, 2 Drawing Sheets

(56) References Cited

U.S. PATENT DOCUMENTS

| | | | | |
|---|---|---|---|---|
| 4,159,792 | A * | 7/1979 | Siegal | A41D 19/0041 224/267 |
| 4,825,475 | A * | 5/1989 | Smart | A41F 17/02 2/312 |
| 5,313,669 | A | 5/1994 | Rasdell et al. | |
| 6,272,691 | B1 * | 8/2001 | Henricksen | A41F 19/005 2/126 |
| 6,393,619 | B1 * | 5/2002 | Bardes | A43B 3/30 2/232 |
| 2014/0189935 | A1 | 7/2014 | Tucker | |

* cited by examiner

SLEEVE CLIP ASSEMBLY

CROSS REFERENCE TO RELATED APPLICATIONS

This application claims priority to U.S. provisional patent Application Ser. No. 62/719,140 filed Aug. 17, 2018, entitled Sleeve Buddy, the disclosure of which is incorporated herein by reference in its entirety.

BACKGROUND OF THE INVENTION

1. Field of the Invention

The present invention relates to the general art of wearing apparel, and to the particular field of a device for retaining a sleeve in position while one dons a sweater or jacket.

2. Brief Description of the Prior Art

Oftentimes, children and physically impaired adults have difficulty donning a sweater and/or a jacket over a long-sleeved shirt. The sleeve of the shirt or sweater often becomes caught on the upper arm, and someone must fish the sleeve out and pull it down into a proper position on the wearer's arm. This can be difficult and cumbersome, especially if the wearer is not capable of cooperating and/or assisting in correctly positioning the sleeve so that a sweater and/or jacket can be properly donned; that is, so that a long-sleeved shirt or blouse can be maintained in a proper positioning while a sweater and/or a jacket is placed over the shirt or blouse.

It is the general practice that when wearing a first article of clothing, such as a long-sleeved shirt or blouse and then donning a second article of clothing such, as for, example, a sweater, jacket, or coat over the first article of clothing, the individual grabs an end of cuff of the sleeve of the first article of clothing with his or her fingers, and then insert his/her arm into the sleeve of the second article of clothing so that bunching of the first article of clothing does not occur.

While there are many designs for a shirt cuff holder, such as the shirt cuff holders disclosed in U.S. Pat. Nos. 216,158; 613,816; 636,765; 778,654; 848,584, and 1,782,057, such devices are designed and intended to hold a shirt cuff on a shirt. As such, these devices are not suitable to hold the shirt and its cuff or a sweater to the wearer's arm during insertion of the wearer's arm into the sleeve of another article of clothing in order to prevent bunching of the shirt sleeve or sweater sleeve during such insertion of the arm. Hence, these prior art devices do not solve the above-described problem.

There is, therefore, a need in the art to provide a device to ensure that a long sleeve of a shirt, a blouse, and/or a sweater remains in proper positioning on the wearer's arm during an operation where another article of clothing is donned over the shirt, blouse, and/or sweater.

SUMMARY OF THE INVENTION

The present invention provides such a need. The present invention provides a sleeve clip assembly and related methods of preventing the bunching of a long-sleeve of a shirt or blouse worn by a user while the user's arm is being inserted into the sleeve of an article of clothing, such as a sweater or jacket. The sleeve clip assembly comprises a clasp assembly that attaches to the sleeve of an article of clothing. The sleeve clip assembly is then wrapped around a user's wrist in order to keep the sleeve down in close proximity to the user's wrist while the user inserts his/her arm into and through the sleeve of the article of clothing.

The sleeve clip assembly of the invention is structured to preventing the bunching of a sleeve of a long-sleeved shirt worn by a user while the user's arm is being inserted into the sleeve of an article of clothing. The sleeve clip assembly comprises a wristband having an elongated body; a first hook-and-loop fastener means and a second hook-and-loop fastener means on the elongated body of the wristband for securing the wristband around the wrist of a user; a band attached to the elongated body of the wristband; a connector element secured to the band; a clasp assembly for gripping a cuff of the sleeve of the long-sleeved shirt; and a hinge attached to the clasp assembly and to the connector element for pivotally connecting the clasp assembly to the band of the wristband of the sleeve clip assembly. In an embodiment of the invention, the clasp assembly is an alligator clamp and the connector element is in the shape of a continuous wire extending through the band of the wristband and through the hinge of the clasp assembly.

Using the sleeve clip assembly and related methods of the present invention permits a person, such as a child, to easily don a sweater or a coat over his shirt or her blouse without causing the sleeve of the shirt or blouse to bunch up as the wearer inserts his/her arm through the sleeve of the sweater or coat.

These and other features, methods, and advantages of the invention will be better appreciated and understood when the following description is read in light of the accompanying drawings.

BRIEF DESCRIPTION OF THE DRAWINGS

The components in the figures are not necessarily to scale, emphasis instead being placed upon illustrating the principles of the invention. Moreover, in the figures, like referenced numerals designate corresponding parts throughout the different view.

DETAILED DESCRIPTION OF THE INVENTION

Referring to FIGS. 1-5, the invention will now be described in more detail. The problem to which the present invention is directed can be understood by referring to FIGS. 1 and 2. As a user wears a long-sleeve shirt LS, and inserts his arm into the sleeve S of another garment, such as a sweater SW, that shirt sleeve often bunches up as illustrated at reference number B in FIG. 2. As discussed herein above, in such situations, someone must reach up inside the sweater sleeve S and pull the shirt down towards the wrist area of the wearer of the long-sleeve shirt LS. Sometimes, this can be cumbersome and/or somewhat annoying. The present invention is intended to overcome this problem by preventing the bunching of a sleeve of a first article of clothing selected from the group consisting of a long-sleeved shirt or blouse, worn by a user while the user's arm is being inserted into the sleeve of a second article of clothing. This second article of clothing may be selected from the group consisting of a sweater, a jacket, a coat, or the like.

Figure 2:
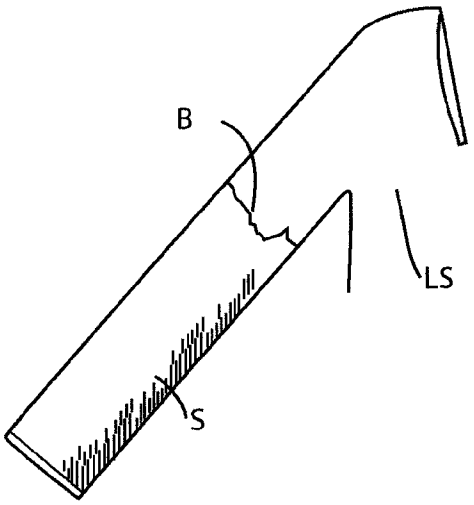
FIG. 2 is a schematic, partial, elevational view of a long-sleeved shirt of FIG. 1 illustrating how the shirt sleeve can be bunched inside a sleeve of a sweater or jacket.
Figure 1:
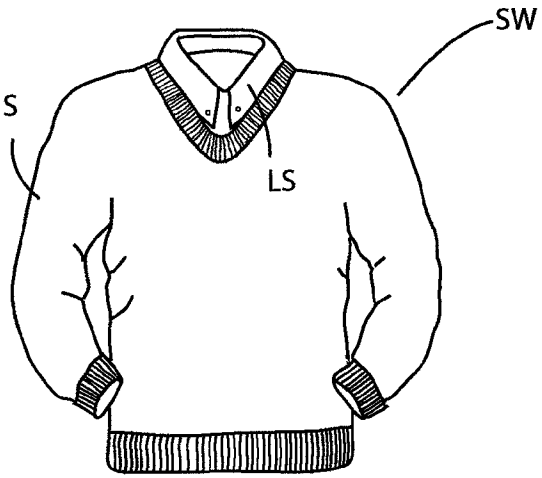
FIG. 1 is a schematic, elevational view of a sweater arranged over a long-sleeved shirt.
Figure 3:
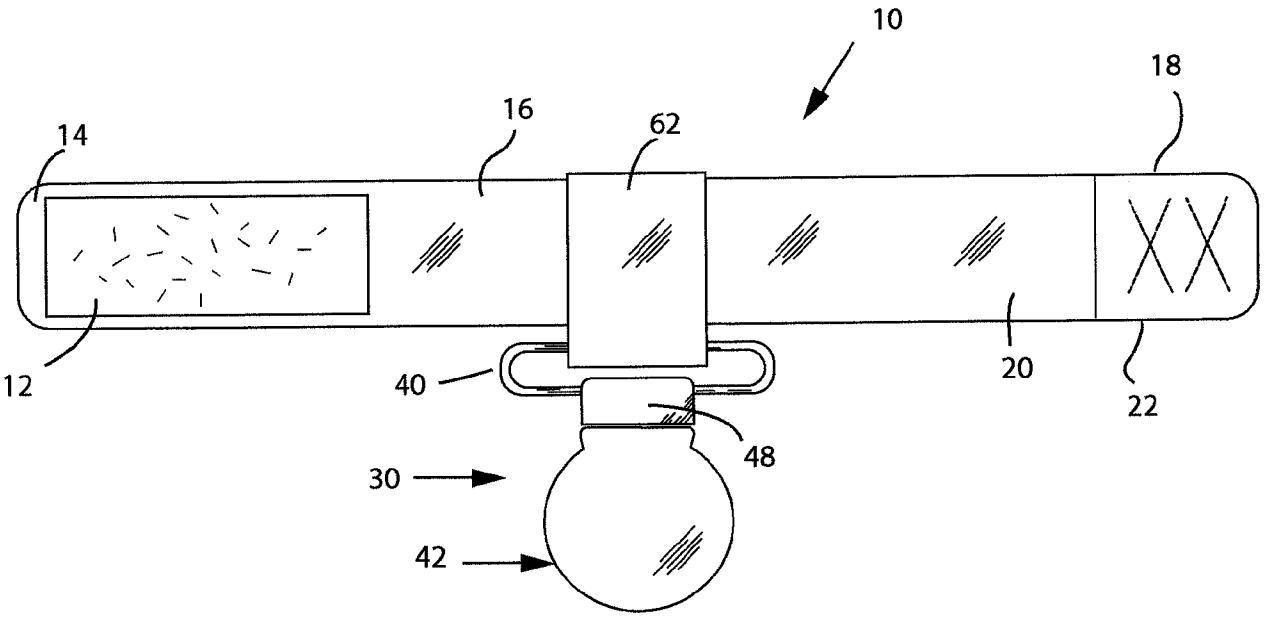
FIG. 3 is a front elevational view of a sleeve clip assembly of the present invention in an expanded, inoperative position.

Referring particularly to FIG. 3, the present invention is embodied in a sleeve clip assembly 10. Sleeve clip assembly 10 comprises a wristband 20, which may be made of a flexible material, such as, for example, elastic or polyethylene. As shown in FIG. 3, wristband 20 has an elongated body with a first hook-and-loop fastener means 12 adjacent to a first end 14 of wristband 20 and a second hook-and-loop fastener means 18 adjacent to a second end 22 of wristband 20. It is to be appreciated that the first hook-and-loop fastener means 12 is located on an outward surface 16 of wristband 20, while second hook-and-loop fastener means 18 is located on an inward surface designated by XX of wristband 20. It is to be appreciated that inward surface XX is opposite to outward surface 16. Wristband 20 is structured to encircle a wearer's wrist and to be secured there to via engagement of first and second hook-and-loop fastener means 12, 18, respectively.

Figure 4:
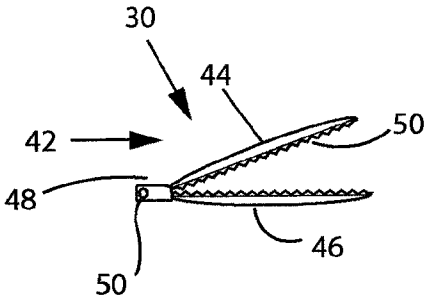
FIG. 4 is a side elevational view of a clasp assembly of the sleeve clip assembly of the present invention.

Still referring particularly to FIG. 3, sleeve clip assembly 10 further comprises a clasp assembly 30. Clasp assembly 30 is attached to wristband 20 via a connector element 40. In an embodiment of the invention and as particularly illustrated in FIG. 4, clasp assembly 30 may be comprised of an alligator clamp 42 having two gripping units 44 and 46. Still referring to FIG. 4, gripping units 44 and 46 have several teeth, one of which is indicated by reference numeral 50. Gripping units 44, 46 are located on an inside surface of alligator clamp 42 such as to be located opposite each other in clasp assembly 30. As illustrated in both FIGS. 3 and 4, clasp assembly 30 is attached to connector element 40 via a hinge 48. Hinge 48, preferably, is rigid, and may be metal or plastic. It is also to be appreciated, that hinge 48 of alligator clamp 42 is generally spring-loaded and acts to apply tension to gripping units 44, 46 such that gripping unit 44, 46 are generally in a closed position. It is also to be appreciated, that in operation of alligator clamp 42, gripping units 44, 46 are caused to move away from each other as shown in FIG. 4 via pressure applied to hinge 48. Such pressure may be applied to hinge 48 through human fingers, such as the fore finger and thumb of an individual. Conversely, gripping units 44, 46 are caused to be moved toward each other for a clamping operation when the applied pressure is removed. Since hinge 48 is spring-loaded, when the pressure is removed, gripping units 44, 46 are caused to separate away from each other. As mentioned, hinge 48 is spring-loaded in a manner well-known to those skilled in the art and is available in the marketplace.

Still referring to FIGS. 3 and 4, and as shown in FIG. 3, connector element 40 is a rigid, circuitous member, and may be comprised of metal or plastic. In an embodiment of the invention, connector element 40 is a continuous piece of wire. As such, connector element 40 extends into an opening 50 of hinge 48 (FIG. 4) to fixedly attach clasp assembly 30 to wristband 20 of sleeve clip assembly 10. Connector element 40 is attached to wristband 20 via a band 62 fixedly attached to wristband 20, Band 62 may be made of flexible material selected from the group consisting of cotton and plastic. Band 62 may be a single strip of material fixedly attached to wristband 20 through suitable means, such as stitching or glue. In a further embodiment of the invention, band 62 may be formed into a loop which may then be slid onto first end 14 or second end 22 of wristband 20 and as shown in FIG. 3 positioned in place along wristband 20 through suitable means, such as stitching or glue. It can be appreciated, that connector element 40 and its attachment to band 62 and hinge 48 allows clamp assembly 30 to pivot upwardly and downwardly with respect to wristband 20 to allow use of the sleeve clip assembly 10, more about which is discussed herein below.

Figure 5:
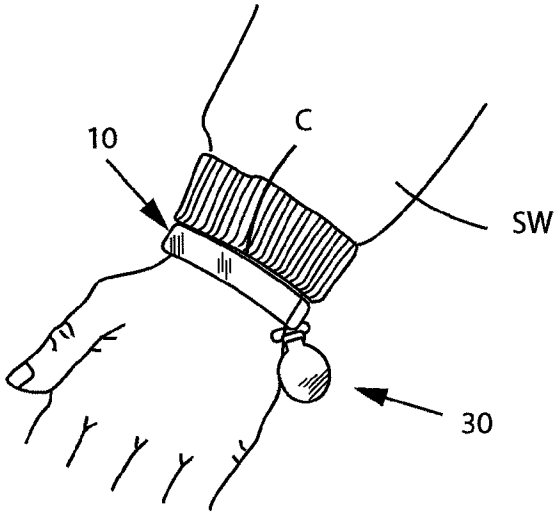
FIG. 5 is a schematic, partial front elevational view of the sleeve clip assembly of the invention secured around the user's wrist after the user's arm and long-sleeved shirt have exited out of the sweater of FIG. 1.

This construction of sleeve clip assembly 10 allows ease and comfort during use of sleeve clip assembly 10 by an individual. That is, in its intended purpose of sleeve clip assembly 10, the clamp assembly 30 must be able to be pivoted upwardly toward wristband 20 when sleeve clip assembly 10 is worn by a user so clamp assembly 30 can be clamped to an edge of a sleeve of a shirt or a blouse for operation of sleeve clip assembly 10 on the wrist of an individual. As shown in FIG. 5, sleeve clip assembly 10 of the invention is wrapped around the wrist of an individual and secured thereto via first and second hook-and-loop fastener means 12 18, and positioned adjacent to a cuff C of the long-sleeved shirt SH (FIG. 2) worn by the individual, more about which is discussed herein below. This positioning of sleeve clip assembly 10 in FIG. 5 may be in a position around the user's wrist in readiness for use thereof if a jacket is to be further donned by the user, or the sleeve clip assembly 10 may be in a position around the user's wrist after the user had already used the sleeve clip assembly 10 in order to don the sweater over the long-sleeved shirt LS.

Methods for using the sleeve clip assembly 10 are also embodied in the present invention. One such method is described with particular reference to FIGS. 3, 4, and 5. This method comprises the steps of a) providing the above-described sleeve clip assembly 10; b) attaching the wrist band 20 to a user's wrist as shown in FIG. 5 by using the first and second hook-and-loop fastener means 12 and 18, respectively; c) attaching the clasp assembly 30 to cuff C of long-sleeved shirt LS worn by the user; d) inserting the user's wrist along with sleeve clip assembly 10 and clasp assembly 30 which is attached to cuff C of the long-sleeved shirt LS into sleeve S of an article of clothing, such as the sweater SW (FIGS. 1 and 5); and e) forcing the user's wrist through the sleeve S of the article of clothing along with sleeve clip assembly 10 and clasp assembly 30 attached to cuff C of the long-sleeved shirt LS. FIG. 5 illustrates the instance where the long-sleeved shirt LS of FIG. 2 has been inserted into the sleeve of the sweater SW of FIG. 1 and the sleeve clip assembly 10 had been utilized to retain the long-sleeved shirt S in an extended position in close proximity to the wrist of the individual.

As illustrated in FIG. 5, when the user's wrist carrying sleeve clip assembly 10 with clasp assembly 30 gripping cuff C of shirt LS has exited the sleeve of the sweater SW, clamp assembly 30 may be released from cuff C of shirt LS; and sleeve clip assembly 10 may be removed from the user's wrist by pulling the second hook-and-loop fastener means 18 away from the first hook-and-loop fastener means 12.

The order of engaging the sleeve clip assembly 10 with the shirt cuff C to the user's wrist may be reversed from that discussed herein above. That is, clamp assembly 30 of sleeve clip assembly 10 may first be attached to cuff C of shirt LS, and then wristband 20 may be secured around the user's wrist via first and second hook-and-loop fastener means 12, 18.

While the present invention has been described in connection with the preferred embodiments of the various figures, it is to be understood that other similar embodiments may be used or modifications and additions may be made to the described embodiments for performing the same function of the present invention without deviating there from. Accordingly, it is intended by the appended claims to cover all such changes and modifications to come within the spirit and scope of the invention.

What is claimed is:

1. A method of preventing bunching of a sleeve of a first article of clothing worn by a user while the user's arm is being inserted into the sleeve of a second article of clothing, the steps comprising:

providing a sleeve clip assembly comprising a wristband, first and second hook-and-loop fastener means on the wristband, a band affixed to the wristband, a connector element attached to the band, and a clasp assembly pivotally attached to the connector element;

attaching the wristband to a user's wrist using the first and second hook-and-loop fastener means;

engaging the clasp assembly to a cuff of the first article of clothing worn by the user;

inserting the user's wrist along with the wristband and clasp assembly into a sleeve of a second article of clothing; and forcing the user's wrist through the sleeve of the second article of clothing along with wristband around the wrist of the user and the clasp assembly secured to the cuff of first article of clothing; and after the user's wrist has exited the sleeve of the second article of clothing, releasing the clamp assembly from the cuff of the first article of clothing and removing the wrist band from the wrist of the user.

2. The method of claim 1, wherein the clasp assembly is an alligator clamp.

3. The method of claim 1, wherein the first article of clothing is selected from the group consisting of a long-sleeve shirt and a long-sleeved blouse and the second article of clothing is selected from the group consisting of a sweater, a jacket, and a coat.

4. A method of preventing bunching of a sleeve of a first article of clothing worn by a user while the user's arm is being inserted into the sleeve of a second article of clothing, the steps comprising:

providing a sleeve clip assembly comprising a wristband, first and second hook-and-loop fastener means on the wristband, a band affixed to the wristband, a connector element attached to the band, and a clasp assembly pivotally attached to the connector element;

attaching the wristband to a user's wrist using the first and second hook-and-loop fastener means;

engaging the clasp assembly to a cuff of the first article of clothing worn by the user;

inserting the user's wrist along with the wristband and clasp assembly into a sleeve of a second article of clothing; and forcing the user's wrist through the sleeve of the second article of clothing along with wristband around the wrist of the user and the clasp assembly secured to the cuff of first article of clothing; and after the user's wrist has exited the sleeve of the second article of clothing, removing the wrist band from the wrist of the user and releasing the clamp assembly from the cuff of the first article of clothing.

5. The method of claim 4, wherein the clasp assembly is an alligator clamp.

6. The method of claim 4, wherein the first article of clothing is selected from the group consisting of a long-sleeve shirt and a long-sleeved blouse and the second article of clothing is selected from the group consisting of a sweater, a jacket, and a coat.

7. A sleeve clip assembly for preventing the bunching of a sleeve of a long-sleeved shirt worn by a user while the user's arm is being inserted into the sleeve of an article of clothing, the clip assembly consisting essentially of:

a wristband having an elongated body for wrapping around the wrist of the user;

a first hook-and-loop fastener means and a second hook-and-loop fastener means, each located on an opposite end of the elongated body of the wristband for securing the wristband around the wrist of the user;

a band attached to the elongated body of the wristband and extending vertically therefrom;

a connector element secured to the band;

a clasp assembly for gripping a cuff of the sleeve of the long-sleeved shirt; and a rigid spring-loaded hinge located between the clasp assembly and the connector element and attached to the clasp assembly and to the connector element for pivotally connecting the clasp assembly to the band of the wristband of the sleeve clip assembly and for operation of the clasp assembly, the connector element, the band, and the hinge being structured and interconnected to pivot clasp assembly upwardly and downwardly relative to the wristband to allow use of the sleeve clip assembly.

8. The sleeve clip assembly of claim 7, wherein the clasp assembly is an alligator clamp.

9. The sleeve clip assembly of claim 7, wherein the connector element is in the shape of a continuous wire extending through the band of the wristband and through the hinge of the clasp assembly.

10. The sleeve clip assembly of claim 7, wherein the article of clothing is a coat.

11. The sleeve clip assembly of claim 7, wherein the article of clothing is a long-sleeved sweater.

12. The sleeve clip assembly of claim 7, wherein the connector element is comprised of a rigid, circuitous member comprised of metal or plastic.

13. The sleeve clip assembly of claim 7, wherein the connector element is comprised of a continuous piece of rigid material.

14. The sleeve clip assembly of claim 7, wherein the hinge is a spring-loaded member.

15. The sleeve clip assembly of claim 7, wherein the wristband is made of a material selected from the group of materials consisting of cotton and plastic.

16. The sleeve clip assembly of claim 7, wherein the band is comprised of material selected from the group consisting of cloth and plastic.

* * * * *